US008291560B2

(12) United States Patent
Peippo

(10) Patent No.: US 8,291,560 B2
(45) Date of Patent: Oct. 23, 2012

(54) IMPACT RAPPING DEVICE

(75) Inventor: Rauno Peippo, Varkaus (FI)

(73) Assignee: Foster Wheeler Energia Oy, Espoo (FI)

( * ) Notice: Subject to any disclaimer, the term of this patent is extended or adjusted under 35 U.S.C. 154(b) by 586 days.

(21) Appl. No.: 12/518,992

(22) PCT Filed: Dec. 13, 2007

(86) PCT No.: PCT/FI2007/050688

§ 371 (c)(1),
(2), (4) Date: Oct. 27, 2009

(87) PCT Pub. No.: WO2008/071852

PCT Pub. Date: Jun. 19, 2008

(65) Prior Publication Data

US 2010/0108340 A1 May 6, 2010

(30) Foreign Application Priority Data

Dec. 14, 2006 (FI) ..... 20065801

(51) Int. Cl.
*B21B 45/04* (2006.01)
*F28G 7/00* (2006.01)

(52) U.S. Cl. ..... 29/81.15; 173/120

(58) Field of Classification Search ..... 29/81.15, 29/81.13; 173/120, 90, 202
See application file for complete search history.

(56) References Cited

U.S. PATENT DOCUMENTS

| | | | | |
|---|---|---|---|---|
| 2,777,535 | A | 1/1957 | Hull | 183/7 |
| 2,985,802 | A | 5/1961 | Drenning | 317/191 |
| 3,605,915 | A | 9/1971 | Gately et al. | 173/116 |
| 3,731,907 | A | 5/1973 | Lash | |
| 3,835,817 | A | 9/1974 | Tuomaala | 122/379 |
| 4,067,549 | A | 1/1978 | Konyak et al. | 74/579 R |
| 4,932,985 | A | 6/1990 | Jonelis et al. | 55/112 |
| 5,079,459 | A | 1/1992 | Huston et al. | 310/15 |
| 5,540,275 | A | 7/1996 | Eisinger | 165/84 |
| 5,561,583 | A | 10/1996 | Shideler | 361/160 |

FOREIGN PATENT DOCUMENTS

| | | |
|---|---|---|
| GB | 2 180 172 | 3/1987 |
| JP | 35-28689 U | 10/1960 |
| JP | 62-087263 A | 4/1987 |
| JP | 7-157777 | 6/1995 |
| JP | 2006-231239 A | 9/2006 |
| RU | 2 092 253 C1 | 10/1997 |

(Continued)

OTHER PUBLICATIONS

Russian Decision on Grant issued Nov. 8, 2010, in counterpart Russian patent application No. 20091296759/06(037244).

(Continued)

*Primary Examiner* — John C Hong
(74) *Attorney, Agent, or Firm* — Fitzpatrick, Cella, Harper & Scinto

(57) ABSTRACT

An impact rapping device includes a stationary anvil integrated with a surface to be rapped, the anvil having a hammering axis perpendicular to the surface to rapped, a hammer arranged to move coaxially with the hammering axis, to hit an impact surface of the anvil, and a device for moving the hammer. The anvil and the hammer form a compact unit, which can be assembled in any position. The hammer is supported to lean on the anvil in such a way that the position of the hammer automatically follows changes of place or position of the anvil, and so that the hammer can move only parallel to the hammering axis.

17 Claims, 4 Drawing Sheets

FOREIGN PATENT DOCUMENTS

| | | |
|---|---|---|
| RU | 2 162 508 C1 | 1/2001 |
| SU | 903690 | 2/1982 |

OTHER PUBLICATIONS

Finnish Office Action dated Jun. 21, 2007, issued in counterpart Finnish patent application No. 20065801.
Finnish Office Action dated Mar. 27, 2009, issued in counterpart Finnish patent application No. 20065801.
International Search Report dated Apr. 25, 2008, which was mailed in a Communication dated May 23, 2008, and which issued in corresponding International Application No. PCT/FI2007/050688.
Written Opinion of the International Searching Authority, which was mailed in a Communication dated May 23, 2008 and which issued in International Application No. PCT/FI2007/050688.
International Preliminary Report on Patentability mailed Feb. 16, 2009, issued in International Application No. PCT/FI2007/050688.
Japanese Official Action mailed Jan. 10, 2012, issued in counterpart Japanese patent application No. 2009-540802.

IMPACT RAPPING DEVICE

This application is a U.S. national stage application of PCT International Application No. PCT/FI2007/050688, filed Dec. 13, 2007, published as PCT Publication No. WO 2008/071852 A1, on Jun. 19, 2008, and which claims priority from Finnish patent application number FI-20065801, filed Dec. 14, 2006.

FIELD OF THE INVENTION

The present invention relates to an impact rapping device, being applicable, for example, for removing fouling from heat sources, plate-structured funnels or channels of steam boilers, or heat recovery tubes for pyrometallurgical processes. Thus, the invention especially relates to an apparatus comprising a stationary anvil integrated with the surface to be rapped, the anvil having a hammering axis perpendicular to the surface to be rapped, a hammer, arranged to move coaxially with the hammering axis to hit an impact surface of the anvil, and a device for moving the hammer.

The fouling of surfaces can disturb the operation of the plant in question, in many ways. For example, the fouling of heat recovery tubes decreases their heat exchange efficiency, and thus, decreases the performance of the process. At the same time, the fouling increases the temperature of the flue gas, and causes disadvantageous results in the channels and devices downstream of the heat recovery stage. On the other hand, for example, the dirt stuck on the surfaces of the flue gas channel can considerably increase the flow resistance of the flue gas, which increases the auxiliary power of the boiler. At its worst, the dirt can even clog channels and, thus, case shutdowns of the plant. Fouling surfaces can be cleaned, for example, by means of steam, pneumatic sootblowers or sonic sootblowers. Especially, in very heavy fouling processes, including chemically reacting, sticky, melted or semi-melted dust particles, or condensing gas components, mechanical rapping devices are also used to clean surfaces. By such devices, the surface is subjected to hits, in order to cause therein rapid, small amplitude vibration. This way, it is possible to have the impurities stuck on the surfaces loosen effectively, without causing excessive mechanical stresses on the surface.

DESCRIPTION OF THE RELATED ART

U.S. Pat. Nos. 3,835,816 and 5,540,275 disclose apparatuses comprising conventional, gravity-operated hammers used for cleaning external heat surfaces in a steam boiler. Such apparatuses are usually rather large and heavy, so they cannot be located in very limited spaces. Additionally, the direction of the hammer impact cannot be chosen freely, so the apparatuses are not applicable, for example, for cleaning the lower sides of the inclined surfaces in funnel-shaped apparatuses. The apparatuses are also noisy, and rather complicated to construct and to assemble, and they require a lot of maintenance.

Japanese Patent No. 7,157,777 discloses a compact rapping device for heat exchange tubes of a gasifier, which is provided inside a casing attached to the outer wall of the gasifier. The hammer of the rapping device, the hammering movement of which is generated by means of a spring tensioned by means of high pressure gas, impacts the end of a hammer arm extending up to the outer wall of the gasifier. The problem with this construction is that both the rapping device and the hammer arm have to be assembled very accurately, to have the impact directed precisely to the end of the hammer arm. Furthermore, the thermal motion of the heat exchange tubes can change the position of the hammer arm in such a way that the impact hits the surface eccentrically or inclined, which, again, may cause, for example, the hammer arm to come loose from the heat exchange tubes.

U.S. Pat. No. 5,079,459 discloses an electromagnetic rapping hammer, in which a back and forth movement of a magnetic core, acting as hammer, is generated, by means of two electromagnets inside a sleeve attached to the outer wall of a heat exchanger. The hammer impacts a hammer arm extending through the outer wall of the heat exchanger, which is attached to the heat exchange tubes of the heat exchanger by means of a spring mechanism. In such a construction, there is no continuous metal vibration channel from the hammer arm to the heat exchange tubes, whereby, even slight rust, dust, etc., between the hammer arm and heat exchange tubes will dampen and change the vibration pulse.

U.S. Pat. No. 5,561,583 discloses an electromagnetic rapping hammer, in which the spring, causing the movement of the hammer, is changed with a solenoid, which is connected to the hammer arm welded to the surface to be rapped by means of a multi-piece connecting element dampening the impact. This arrangement may have a problem that the connecting element is too rigid, and transfers vibration, whereby, the guiding device of the solenoid can be damaged and/or that the connecting element is too flexible, whereby the impact may be inclined, which, again, may damage the magnetic core, the hammer arm or the joint between the surface to be rapped and the hammer arm.

SUMMARY OF THE INVENTION

It is an object of the present invention to provide an efficient rapping device for fouling surfaces, in which the above-described problems of the prior art devices have been minimized.

In order to minimize the above-mentioned prior art problems, an apparatus is provided, the characterizing feature of which is that a hammer is supported to lean on an anvil in such a way that the hammer can move only parallel to the hammering axis.

The anvil and the hammer supported to lean on the anvil from a compact unit, which can be easily assembled and pretensioned, before the final assembly to the place where it is used. The rapping device is typically assembled by welding the anvil thereof from the first end, i.e., from the end of the side of the surface to be rapped, directly to the surface to be rapped, or to an impact beam transferring the impact to the surface to be rapped. When the rapping device is assembled to the place where it is used, the direction of the hammering movement of the hammer is always correct, because the position of the hammer automatically follows small changes of place or position of the anvil, for example, due to thermal movements, which thus, do not affect the operation of the rapping device.

The hammer is preferably forced to move in the direction of the hammering axis, in such a way that the hammer is supported to lean on the anvil by at least one sliding element arranged between the anvil and the hammer. At its simplest, the sliding elements comprise one sliding sleeve, but, in order to arrange a stable support for the hammer, there are usually at least two sliding sleeves or sliding elements of other shapes. One of the two sliding sleeves can preferably be attached to the anvil and the other to the hammer. In some cases, all sliding elements can preferably be attached to the anvil, and in other cases, they may correspondingly be attached to the hammer.

According to the present invention, the hammer is supported to lean on the anvil in such a way that the hammer can move only in one direction. This can be realized, for example, in such a way that one part of the anvil prevents movements of the hammer in other directions. In some special cases, when the assembly position of the rapping device is predetermined, it may be sufficient that the anvil supports the hammer only from below and from the sides. The structure of the anvil, in accordance with the invention, is preferably such that one of its parts prevents all possible transverse movements of the hammer, and, therefore, the anvil and the hammer of the rapping device are preferably arranged to move, at least partially, with each other.

According to a preferred embodiment of the present invention, the hammer is bowl-shaped, in other words, cup-like, with an axis parallel to the hammering axis, and the hammer is arranged to move in such a way that it surrounds closely at least one portion of the anvil parallel to the hammering axis, by means of sliding sleeves or pieces. If the cup-like hammer has a solid bottom, the end portion of the anvil, in other words, the end looking away from the surface to be rapped, can remain inside the casing of the hammer when hitting the hammer. If, in turn, there is an opening in the bottom of the cup-like hammer, the end portion of the anvil may extend at the end of the impact through an opening outside the hammer. According to another preferred embodiment, the anvil has a shape of a hollow cylinder or bowl, with an axis parallel to the hammering axis, and the hammer is arranged to move in such a way that it penetrates, at least partially, inside the anvil.

According to a preferred embodiment, the surface of the anvil which receives the impact, i.e., the impact surface, is arranged to hit at least the end of the impact inside the casing of the cup-like hammer. If there is an opening at the bottom of the cup-like hammer, the hammer is preferably sealed by two sliding sleeves around the anvil, in such a way that the first sliding sleeve is connected between the outer surface of the portion on the first side, i.e., the body portion of the anvil, and the inner surface of the cup-like hammer. There, the second sliding sleeve is preferably connected, as seen from the impact surface of the anvil, between the outer surface of the end portion, i.e., the tail portion of the anvil, and the inner surface of the opening in the bottom of the hammer. A special advantage in such embodiments is that the bowl-shaped portion of the hammer acts as an acoustic sleeve dampening the noise to the environment caused by the hammering impacts of the device. In the embodiments of the invention, in which the impact surface remains outside the structure of the hammer, the noise of the rapping device may be diminished owing to its compact structure, preferably, by a separate acoustic casing, which may be connected, for example, to the outer surface of the device to be cleaned or, alternatively, to the anvil.

In order to provide a durable and operating arrangement, the anvil can preferably be a single piece. Alternatively, the anvil may consist of a number of pieces, which are durably integrated with each other in such a way that they form a continuous and compact entity. Respectively, the hammer can advantageously be either a single piece, or it may consist of a number of pieces integrated durably with each other. In some applications, the anvil can also be assembled of more pieces in such a way that a cylindrical portion may, to a certain extent, be flexible in the direction of the hammering axis, in such a way that all inclined or transverse movements are prevented. By such arrangements, it is possible to maintain the movement of the hammer leaning to the cylindrical portion in the right direction, at the same time as the impact of the hit is dampened from transferring to the cylindrical portion.

The hammering movement of a rapping device in accordance with the invention can be provided, for example, directly pneumatically, or by means of electromagnets. In order to create the hammering movement, the means to be used comprise, however, preferably, a spring, which is tensioned by means of a tensioning device through an appropriate drive means. The tensioning of the spring can preferably be released by using an adjustable releasing mechanism at a desired tensioning level, whereby, the released hammer hits at a great speed towards the impact surface of the anvil.

The spring is preferably arranged between supporting surfaces attached to the hammer and the anvil, preferably, in such a way that when tensioning, the spring is compressed in the direction of the hammering axis and when released, it extends to its original rest length. In order for the size of the rapping device to be maintained small, the strokelength of the hammer is, preferably, relatively short. However, the strokelength is preferably so long that the hammer may achieve a sufficient speed with a reasonable acceleration, preferably 1-5 g, most preferably, with an acceleration of 2-3 g. Thereby, the reaction force caused on the supporting surface of the anvil of the spring remains relatively small, and the durability of the supporting surface of the anvil improves.

The spring force of the spring must be dimensioned such that the desired acceleration is achieved by a chosen hammer weight, which is, typically, 30-40 kg. For example, in order to achieve the initial acceleration of 2.5 g, the spring force must then be, as tensioned, 750-1000 N. The spring is preferably chosen in such a way that even at the end of the impact, there is still more spring force left than the weight of the hammer, for example, 400-500 N, whereby the hammer of the rapping device does not move in the transportation, nor in the assembly, and it also has a stable rest position when the direction of the impact is upwards, for example, to the outer surface of the bottom of a funnel.

The tensioning device of the spring may preferably be, for example, a motor, a pneumatic or hydraulic cylinder, or an electromagnet. At least the most sensitive parts of the tensioning device, for example, the motor and its gears, are not supported, in accordance with a preferred embodiment of the invention, from the anvil, but they are separately supported by an external supporting structure. Thereby, the vibrations of the anvil do not transfer to the sensitive parts of the tensioning device, and the risk of them getting broken diminishes. The driving mechanism of the tensioning device must then be flexibly floating or it must otherwise allow the moving of the rapping device due to the thermal movements of the surface to be rapped.

According to a preferred embodiment of the invention, there is arranged a so-called spring bank between the hammer and the anvil, in other words, an element which is flexible, with a high spring constant, in the direction of the hammering axis. The spring bank is preferably a pair of rigid cup springs, but it can also be a flexible foil with a suitable spring constant. The spring bank can be attached either to the anvil or to the hammer moving therewith. The spring bank slows down to a certain extent the deceleration of the hammering movement, and, thus, decreases the forces and stresses and the risk of damaging the hammer and the anvil. The spring constant of the spring bank is preferably such that the maximum deceleration of the hammer is on the order of 500-1000 g. It has been proven, in practice, that, to a certain extent, such a decelerated impact also removes impurities more efficiently from the surfaces to be rapped than does a completely inflexible impact.

The movement of the hammer of a rapping device in accordance with the present invention is directed in the manufacturing stage to be parallel to a hammering line of the anvil. The rapping device, thus, does not require alignment between the anvil and the hammer when assembling the device, or realigning, for example, when increasing the temperature of the heat exchange tubes to be rapped. The apparatus thus eliminates the bending moment against the anvil due to an incorrect aligning of the hammer, and the damage of the anvil due to that, as well as the damage of the joint connecting the anvil to the surface to be rapped. A correctly aligned impact also improves the transfer efficiency of the impact to the surface to be rapped.

The rapping device is simple in the structure and it may be preassembled in the manufacturing stage. This simplifies the assembly of the apparatus and decreases the costs of the apparatus, as well as the maintenance need thereof. The apparatus is a compact unit, which may be easily noise-shielded and assembled to any position needed. In practical applications, there is usually a large number of rapping devices, which can be completely separate or they may have, for example, a common pneumatic tensioning device, which guides the rapping pulses in a suitable sequence to a different rapping device. Owing to the small size and low weight, they can be assembled even to narrow spaces and, also, close to each other, if necessary.

BRIEF DESCRIPTION OF THE DRAWINGS

The invention is described below with reference to the accompanying drawings, in which FIGS. 1-7 schematically illustrate cross sections of different rapping devices in accordance with the present invention.

DETAILED DESCRIPTION OF THE PREFERRED EMBODIMENTS

Figure 1:
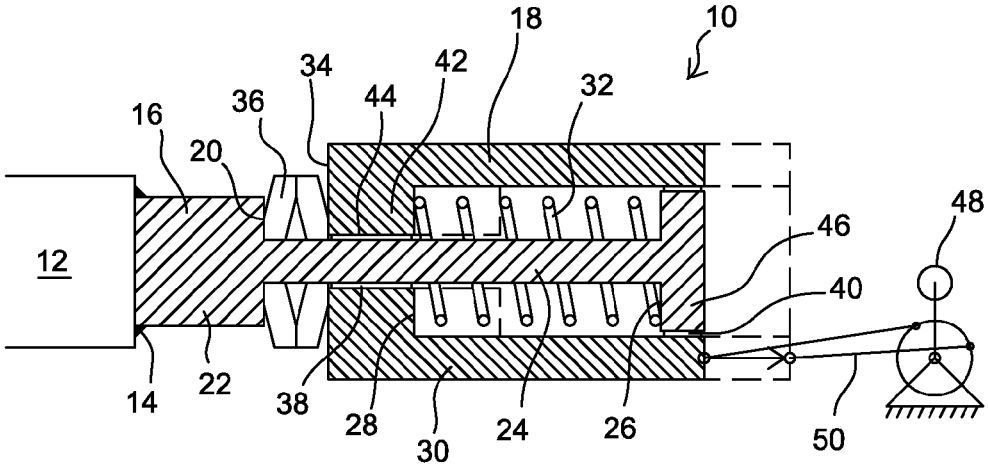

FIG. 1 illustrates a rapping device 10, in accordance with a preferred embodiment of the present invention, comprising an anvil 16 attached by means of a welded seam 14 to a hammering beam 12 and a hammer 18 connected to the anvil 16. If the wall to be rapped is, for example, an outer wall of a reactor, channel or funnel, one end of the hammering beam 12, (not shown in FIG. 1), may be welded to the wall. Alternatively, in such a case, a separate hammering beam 12 is not necessary, but the anvil 16 may be connected directly to the wall to be rapped. If, in turn, there are, for example, heat exchange tube banks in the gas-tight space of a reactor or a steam boiler are to be rapped, the hammering beam 12 may be flexibly sealed to the wall of the gas space and welded to the heat exchange tubes or their connecting piece. Since the different sealing and attaching methods of the hammering beam 12 are of a known technique, they will not be described below in detail.

The anvil 16 comprises a surface receiving the impacts, i.e., an impact surface 20, separating a body portion 22 of the anvil 16 on the side of the hammering beam 12 and a tail portion 24 further from the hammering beam 12. Between the supporting levels 26, 28 of the anvil 16 and the hammer 18, a spring 32 is arranged inside a cup-like portion 30 of the hammer 18, by means of which the hammer 18 is brought to hammering movement towards the impact surface 20 of the anvil 16. Between the impact surface 20 of the anvil 16 and the hammering surface 34 of the hammer 18, there is preferably arranged a pair of cup springs, a so-called spring bank 36, having a high spring constant dampening the stopping of the hammer 18 and, thus, extending the duration of a single impact, without substantially diminishing the total amount of the hammering energy. According to an exemplary solution, the deceleration of the movement of hammer 18 is preferably at most on the order of 1000 g.

Durable sliding pieces, preferably, sliding sleeves 38, 40 having a low friction coefficient are arranged between the tail portion 24 of the anvil 16 and the hammer 18. By means of sliding sleeves, the anvil 16 prevents the transverse movements of the hammer 18 and, thus, allows the hammer 18 to move only accurately in the axial direction of the anvil 16. The sliding sleeves 38, 40 are wearing pieces and thus, they are easily exchangeable. In a construction in accordance with FIG. 1, the bottom portion 42 of the hammer 18 acts as the front part of the hammer 18, and the inner sliding sleeve 38 on the spring bank side, is attached to the inner surface of a hole formed in the bottom portion 42 of the hammer 18. The outer sliding sleeve 40, in turn, is connected in the embodiment in accordance with FIG. 1 to the outer surface of an extension 46 of the tail portion 24 of the anvil 16.

The rapping device 10 in FIG. 1 is illustrated in an impact position, in other words, in a position in which the spring 32 is in its maximum length and the hammer 18 is in contact with the spring bank 36 of the anvil 16. When using the rapping device 10, the spring is preferably tensioned by drawing hammer 18 outwards by a separately supported motor 48, or some other tensioning device, for example, an electromagnet. A flexibly connected mechanism 50 transfers the force of the tensioning device to the hammer 18. When the spring 32 is in a desired tension, the impact is caused by releasing the spring 32, whereby the hammering surface 34 of the hammer 18 hits at a high speed to the spring bank 36, causing an impact to the impact surface 20 of the anvil 18. Since the direction of the hammer movement of the hammer 18 is defined by the sliding sleeves 38, 40 between the hammer 18 and the anvil 16, the impact is always appropriately directed relative to the anvil 16.

The strokelength, in other words, the change in the length of the spring 32 to be utilized when using the apparatus, is preferably 50-500 mm, more preferably, 100-300 mm, and most preferably, 100-200 mm. According to a preferred, although exemplary embodiment, the length of the impact is approximately 150 mm, the mass of the hammer 18 is 40 kg, the spring force at maximum tension is 1000 N and, at the end of impact, is still 500 N. Thereby, the initial acceleration of the impact is 25 $m/s^2$ and the impact energy 112 Nm. By adjusting the strokelength of the rapping device 10, it is naturally possible to adjust the strength of the impact. The advantageous values of the parameters of the rapping device 10 depend on the application where the rapping device is used, so they may deviate a lot from the exemplary values described above.

In FIGS. 2-7, which illustrate other preferred embodiments of the rapping device in accordance with the invention, the parts corresponding to those illustrated in FIG. 1 are disclosed with the same reference numbers as those in FIG. 1.

Figure 2:
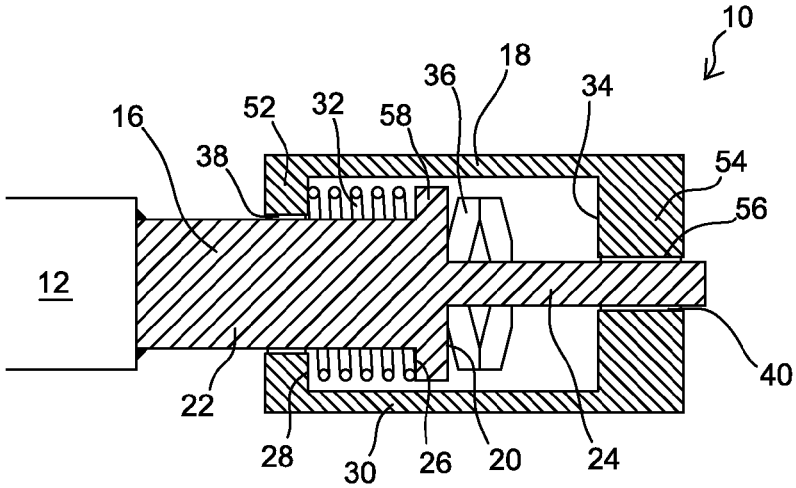

FIG. 2 illustrates a rapping device 10 in accordance with a second preferred embodiment of the present invention. The rapping device 10 of FIG. 2 is illustrated in a tensioned state, whereby, the spring 32 is compressed by a suitable tensioning device (not shown in FIG. 2) to its minimum length and the hammer surface 34 of the hammer 18 is not in contact with the spring bank 36. The rapping device 10 of FIG. 2 deviates from the rapping device 10 of FIG. 1 in that the spring 32 is arranged between the supporting surfaces 26, 28 of the anvil 16 and the hammer 18 around the body portion 22 of the anvil 16, the impact surface 20 and the spring bank 36 remain inside the cup-like portion 30 of the hammer 18. A special advantage in this particular embodiment is that the hammer 18 forms an acoustic casing, which efficiently prevents the noise caused by the impacts of the hammer 18 from spreading to the environment.

In the arrangement illustrated in FIG. 2, the inner sliding sleeve 38, arranged around the body portion 22 of the anvil 16, is attached to the inner surface of an inside extension 42 of the front portion of the hammer 18, and the outer sliding sleeve 40, arranged around the tail portion 24 of the anvil 16, is attached to the inner surface of a hole 56 formed to the bottom portion 54, acting as a rear portion of the hammer 18. According to an alternative embodiment, the bottom portion 54 of the hammer 18 can be closed, whereby the tail portion 24 of the anvil 16 can be very short and the sliding sleeve 40, illustrated in FIG. 2, can be replaced by a sliding sleeve attached to the outer surface of the extension 58 of the body portion 22 of the anvil 16. A hammer 18 is provided by this arrangement, which prevents very well the noise of the impacts, and is very strong and durable in construction.

Figure 3:
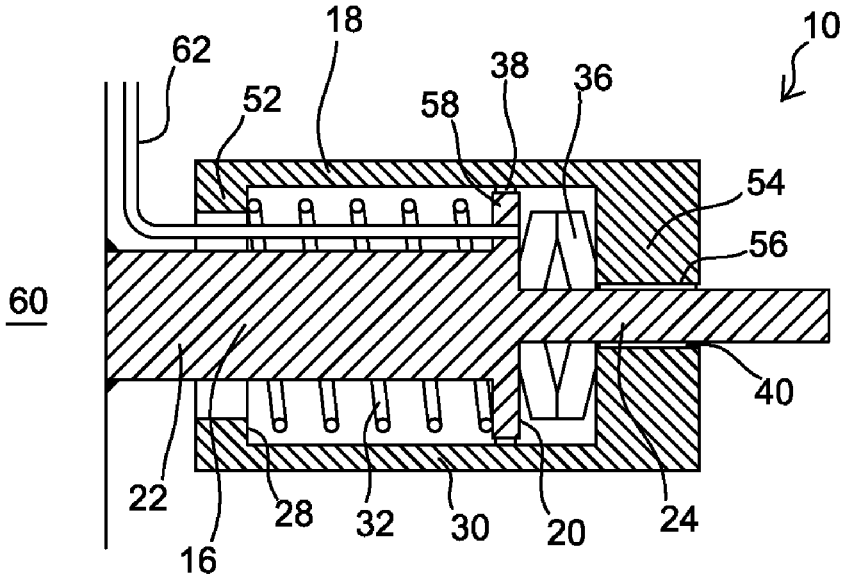

A rapping device 10, illustrated in FIG. 3, the anvil 16 of which is welded directly to wall 60 to be rapped, deviates from the rapping device illustrated in FIG. 2, in particular, in that it comprises the necessary changes for the use of a pneumatic tensioning device (not shown in FIG. 3). In this arrangement, an inside extension 52 of the front portion of the hammer 18 forms a supporting plane 28 of the spring 32, and a sliding sleeve 38, 40 is not attached thereto, but there is a free space between the extension 52 and the body portion 22 of the anvil 16 for a pressurized gas tube 62. In the arrangement of FIG. 3, an inner sliding sleeve 38 is attached to the outer surface of the extension 58 of the body portion of the anvil 16. This inner sliding sleeve 38, in the embodiment of FIG. 3, is attached to the outer surface of the extension 58 of the body part of the anvil 16. The inner sliding sleeve 38 and the cup-like portion 30 of the hammer 18, as well as the outer sliding sleeve 40 attached to the inner surface of the hole 56 formed in the bottom part 54 of the hammer 18 and the tail portion 24 of the anvil 16 form gas-tight joints. Thus, a gas-tight cavity, comprising an impact surface 20 and a spring bank 36, is formed in the space defined by them, and the spring 32 can be tensioned by raising the pressure of the cavity by means of bringing gas to the cavity, for example, pressurized, along the tube 62 running beside the body portion 22 of the anvil 16. Another possibility to pressurize the cavity is to bring gas therein through the tail portion 24 of the anvil 16 along an axially drilled channel (not shown in FIG. 3). The spring 32 can now be released by letting the gas flow rapidly from the cavity by means of some appropriate conventional device (not shown in FIG. 3).

Figure 4:
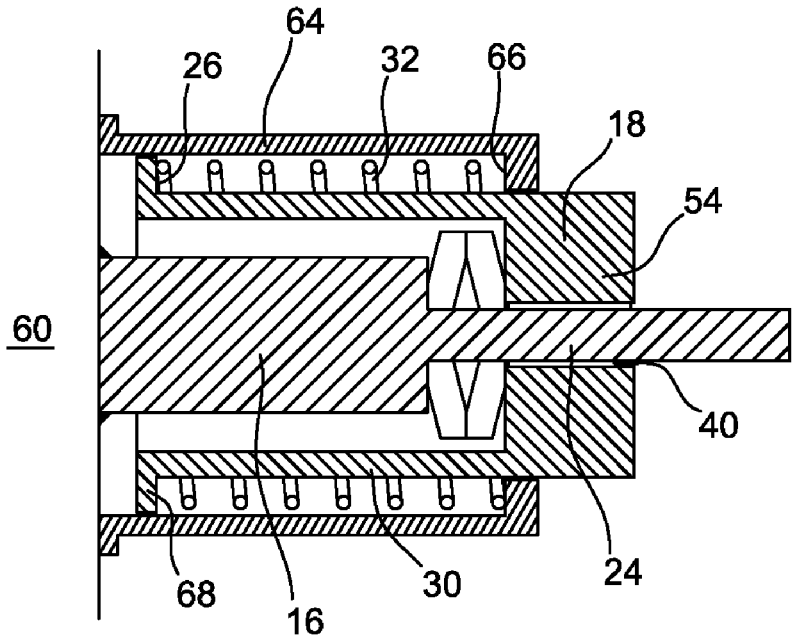

FIG. 4 illustrates an embodiment of the present invention, which deviates from the rapping device of FIG. 2, in that it comprises a casing 64 connected to a wall 60 to be rapped, which casing acts as an additional noise shielding. Furthermore, the spring 32 in the embodiment in accordance with FIG. 4 is arranged between the supporting planes 26, 66 of the hammer 18 and the casing 64. In the embodiment in accordance with FIG. 4, a long enough sliding sleeve 40, arranged between the outer surface of the tail portion 24 of the anvil 16 and the bottom portion 54 of the hammer 18, alone, determines the direction of the hammering movement of the hammer 18. When the anvil 16 and the casing 64 are both attached directly to the surface 60 to be rapped, it is possible, in some cases, to arrange at least one sliding piece, preferably, a sliding sleeve, also between the hammer 18 and the casing 64, attached, for example, to the outer surface of an outside extension 68 of the cup-like portion 30 of the hammer 18.

Figure 5:
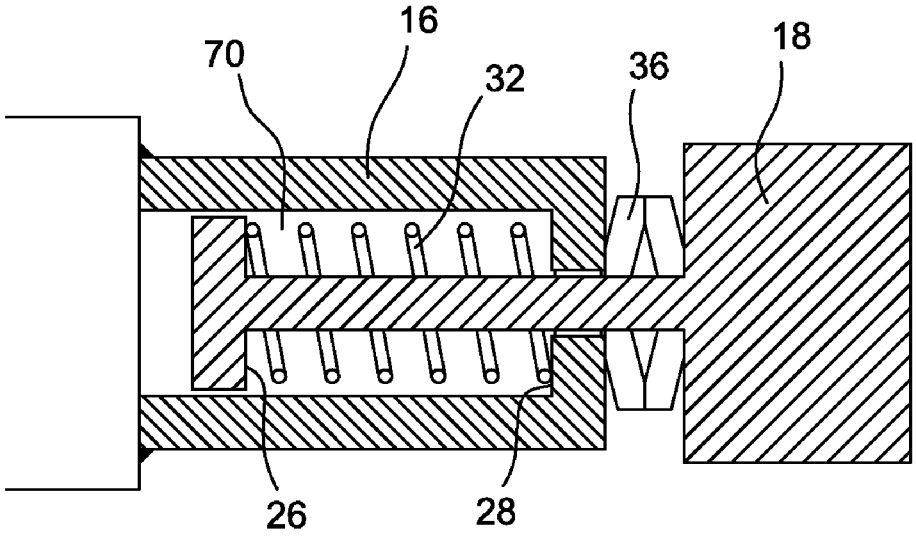
Figure 6:
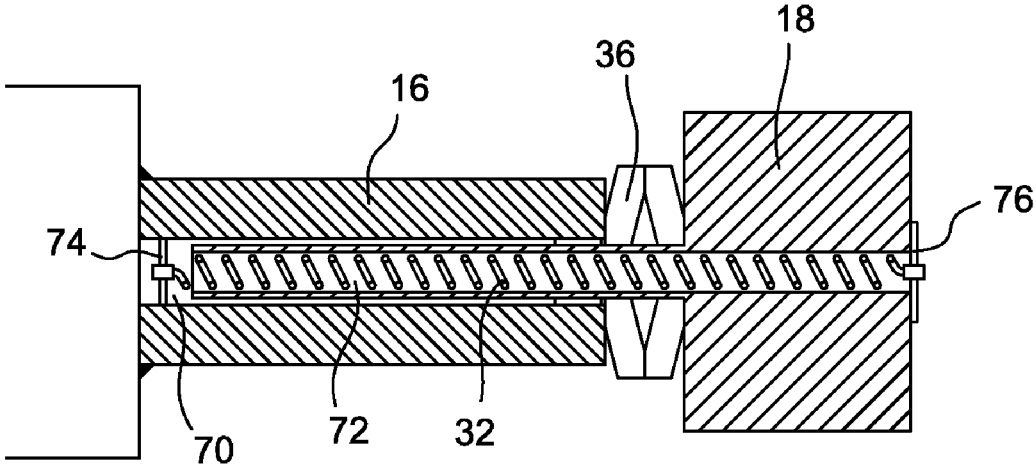

In the embodiments illustrated in FIGS. 1-4, a cup-like hammer 18, i.e., a hammer with a cavity, is arranged to move around a solid anvil 16. FIGS. 5-6 illustrate other kinds of arrangements having a cavity 70 formed inside the anvil 16 and the hammer 18 is arranged to partially penetrate inside the cavity 70 of the anvil 16. In the arrangement of FIG. 5, the spring 32, arranged in the cavity 70 of the anvil 16 between the supporting planes 26, 28 of the anvil 16 and the hammer 18, is charged in a manner corresponding to those of FIGS. 1-4, by pulling or pushing the hammer 18 by a suitable tensioning device outwards, whereby the spring 32 compresses.

An arrangement disclosed in FIG. 6, on the other hand, deviates from all other disclosed arrangements in that the spring 32 is arranged in a cavity 72 formed inside the hammer 18, which hammer 18 is arranged to penetrate inside a cavity 70 of the anvil 16. As with the rapping devices in all other embodiments, the one in FIG. 6 is charged for the impact by pulling or pushing the hammer 18 outwards. The spring 32 of the rapping device 10 of FIG. 6 is, however, an extension spring attached between supporting rods 74, 76 attached to the anvil 16 and the hammer 18, and it is tensioned by extending the spring 32 to a desired tension.

Figure 7:
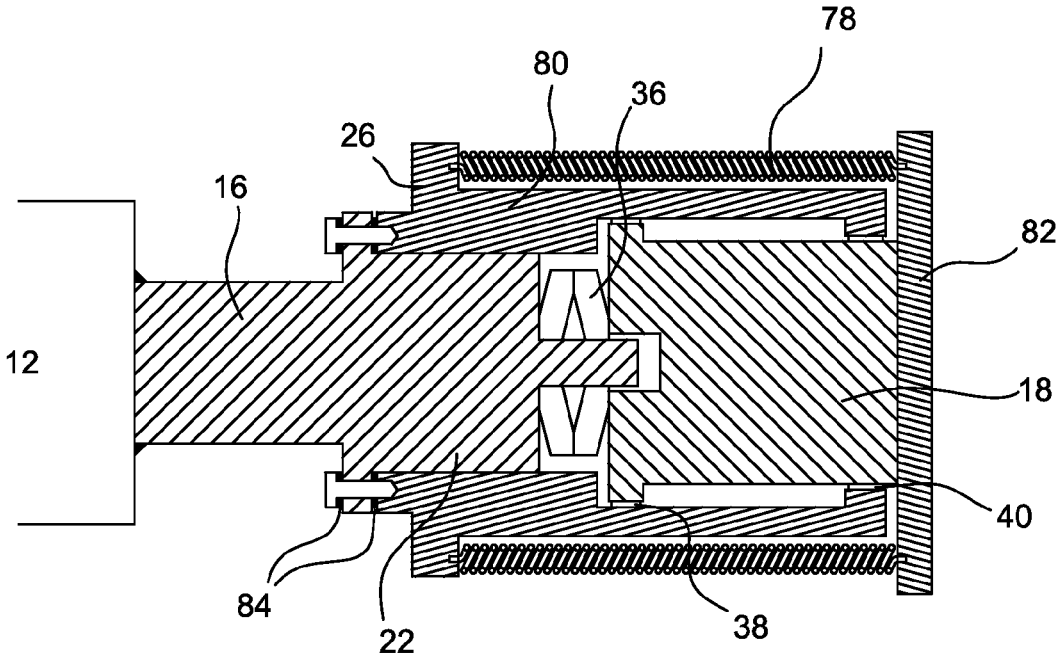

A rapping device 10, illustrated in FIG. 7, deviates from the previous embodiments, especially, in that at least two extension springs 78, which generate the hammering movement, are arranged outside the rest of the structure. When using the device, the hammer 18 penetrates inside a cylindrical portion 80 associated with the anvil 16. The springs 78 are attached between a supporting plane 26 of the cylindrical portion and an end portion 82 associated with the hammer 18. In the case of the figure, the direction of the movement of the hammer 18 is determined by the sliding sleeves 38, 40, which are arranged between the hammer 18 and the cylindrical portion 80 of the anvil 16, and the spring bank 36 is arranged around the tail portion 24 of the anvil 16. The impacts of the rapping device may preferably be charged, for example, pneumatically, by leading pressurized air through the cylindrical portion 80 to the cavity around the spring bank.

The cylindrical portion 80 of the anvil 16 can be firmly integrated with the body portion 22 of the anvil 16, but, in some cases, it is advantageous to use suitable flexible elements, for example, cup springs 84, in connecting the portions to each other, which, to a certain extent, diminish the transfer of the impact of the hammer 18 to the cylindrical portion 80. When using the flexible attachment, it must especially be taken into consideration that the movement between the body portion 22 and the cylindrical portion 80 of the anvil 16 is allowed only in the direction of the hammering axis, and all transverse or inclined movements are prevented. In the rapping device 10 of FIG. 7, the inner surface of the cylindrical portion is accurately fitted with the outer surface of the body portion, in order to prevent the transverse movements between the body portion 22 and the cylindrical portion 80 of the anvil 16.

The present invention is described above with reference to exemplary embodiments, but the invention also comprises many other embodiments and modifications. It is thus evident that the disclosed exemplary embodiments are not intended to restrict the scope of invention, but the invention comprises a number of other embodiments, which are limited by the accompanying claims, and the definitions therein alone.

The invention claimed is:

1. An impact rapping device comprising:

a stationary anvil integrated with a surface to be rapped, the anvil having an impact surface and a hammering axis perpendicular to the surface to rapped;

a hammer, arranged to move coaxially with the hammering axis, to hit the impact surface of the anvil;

a moving device for moving the hammer; and at least one sliding element arranged between the anvil and the hammer, wherein the anvil, the sliding element, and the hammer form a compact unit, which can be assembled in any position, and the hammer is supported to lean on the anvil, with the at least one sliding element arranged therebetween, in such a way that the position of the hammer automatically follows changes of place or position of the anvil, and so that the hammer can move only parallel to the hammering axis.

2. An impact rapping device in accordance with claim 1, wherein the sliding element is a sliding sleeve.

3. An impact rapping device in accordance with claim 2, further comprising two sliding sleeves arranged between the anvil and the hammer.

4. An impact rapping device in accordance with claim 1, wherein the hammer is arranged to move in such a way that one of (i) the hammer gets at least partially within the anvil, and (ii) the anvil gets at least partially inside the hammer.

5. An impact rapping device in accordance with claim 4, wherein the hammer is bowl-shaped and arranged to move in such a way that the anvil gets at least partially inside the hammer.

6. An impact rapping device in accordance with claim 5, wherein the impact surface of the anvil is impacted at the end of a hit inside the hammer, in such a way that the hammer acts as a noise reducing casing.

7. An impact rapping device in accordance with claim 4, wherein the anvil is one of a cylinder and bowl-shaped, and the hammer is arranged to move at least partially into the anvil.

8. An impact rapping device in accordance with claim 7, wherein the anvil comprises a cylindrical part flexibly supported to a body of the anvil, in such a way that the cylindrical part can move relative to the body only parallel to the hammering axis.

9. An impact rapping device in accordance with claim 1, wherein the moving device for moving the hammer comprises a spring.

10. An impact rapping device in accordance with claim 9, wherein the spring is a compression spring.

11. An impact rapping device in accordance with claim 9, wherein the spring is an extension spring.

12. An impact rapping device in accordance with claim 11, further comprising at least two extension springs, arranged outside the anvil and the hammer.

13. An impact rapping device in accordance with claim 9, wherein the rapping device comprises a tensioner for tensioning the spring, the tensioner being at least partially supported separately from the anvil.

14. An impact rapping device in accordance with claim 13, wherein the tensioner comprises a motor.

15. An impact rapping device in accordance with claim 13, wherein the tensioner comprises a pneumatic tensioning device.

16. An impact rapping device in accordance with claim 13, wherein the tensioner comprises an electromagnetic tensioning device.

17. An impact rapping device in accordance with claim 1, further comprising a spring bank arranged between the hammer and the impact surface of the anvil.

* * * * *